US005096750A

United States Patent [19]

Edlert et al.

[11] Patent Number: 5,096,750

[45] Date of Patent: Mar. 17, 1992

[54] APPARATUS AND METHOD FOR CURTAIN COATING OF PAINT OR VARNISH

[75] Inventors: Per Edlert, Ängelholm; Bengt G. Nilsson, Klippan, both of Sweden

[73] Assignee: Swedoor AB, Sweden

[21] Appl. No.: 574,471

[22] Filed: Aug. 28, 1990

[30] Foreign Application Priority Data

May 4, 1990 [EP] European Pat. Off. ..... 90850165.3

[51] Int. Cl.[5] ..... B05D 1/30

[52] U.S. Cl. ..... 427/420; 118/DIG. 4; 118/300

[58] Field of Search ..... 427/420; 118/DIG. 4, 118/300

[56] References Cited

U.S. PATENT DOCUMENTS 3,074,374 1/1963 Burkle ..... 118/324
3,341,354 9/1967 Woods et al. ..... 118/324 X
4,230,743 10/1980 Nakamura et al. ..... 427/420 X

FOREIGN PATENT DOCUMENTS 97789 4/1961 Netherlands .
853616 11/1960 United Kingdom .

*Primary Examiner*—Shrive Beck
*Assistant Examiner*—Alan Bashore
*Attorney, Agent, or Firm*—Lerner, David, Littenberg, Krumholz & Mentlik

[57] ABSTRACT

An apparatus and a method for curtain coating of paint or varnish on objects having profiled application surfaces, such as profiled door leaves, comprising a curtain head provided with a paint/varnish inlet and return outlet. The curtain head hereby exhibits two curtain lips positioned opposite each other, as well as an upper and a lower flow-equalization rail. The curtain head is further positioned at a predetermined height over a collector channel. A return line connects the return outlet with the collector channel and a conveyor is arranged to feed the profiled object inbetween the curtain head and the collector channel when applying the paint/varnish. The invention relates specifically to that the curtain height between the lowermost edge of the curtain lips and the application surface of the profiled object is at least 250 mm, and that the distance between the upper and the lower flow-equalization rail decreases in a direction from the paint/varnish inlet to the return outlet.

23 Claims, 5 Drawing Sheets

APPARATUS AND METHOD FOR CURTAIN COATING OF PAINT OR VARNISH

The present invention relates to an apparatus and a method for curtain coating of paint or varnish on objects having profiled application surfaces, such as for instance profiled door leaves in the shape of panel doors etc.

BACKGROUND OF THE INVENTION

When painting door leaves with aesthetically attractive profiling, spray coating is today definitely the predominant method. As for simpler, flat door leaves, spray coating as well as curtain coating of either paint or varnish can be used.

In comparison with spray coating, curtain coating offers an economically considerably more attractive method which additionally offers larger capacity. A drawback with spray coating is the large paint losses—often exceeding 50 % or more—which inevitably arise in the spray coating process, and which also means an increased health-endangering of personnel near the apparatus. Another important drawback is that the feed speed of the object in spray coating are lower than the corresponding speed in curtain coating, which, productionwise means that the method is also more expensive.

Today, a widespread opinion is that only flat door leaves can be painted with curtain coating, since curtain coating of profiled door leaves, for instance of the panel type, results in that the so called shade side of the profiled surfaces will not obtain a satisfactory coverage of paint or varnish. The so called shade side may hereby be defined as the application surfaces facing opposite the direction of feed of the conveyor.

It is thus considered impossible to paint profiled door leaves with a satisfactory result by using curtain coating.

A known, but less successful attempt to solve the problem is to angle the conveyor in order to "get at" the shade side. However, the angling creates new shade sides and the result is thus completely unsatisfactory.

Another known attempt is to run the door leaf a first time through the curtain and then to turn the door leaf around and run it through a second time so as to also reach said shade side. Such a method is however production-wise very unsatisfactory since the capacity of the apparatus will be halved.

TECHNICAL PROBLEM

The problem with known prior art is thus that one does not succeed in covering said shade sides in a satisfactory way when curtain coating paint or varnish on objects having profiled application surfaces, wherethrough the widespread technical prejudice judging curtain coating in such circumstances impossible, is further enhanced. The industry is thus forced to use the more expensive, slower and more health endangering method of spray coating.

OBJECT OF THE INVENTION

It is the object of the present invention to alleviate the above problem by providing an apparatus and a method for curtain coating of paint or varnish on objects having profiled application surfaces, such as profiled door leaves, where said shade sides obtain a complete covering with paint or varnish while retaining the superior economy of curtain coating.

SUMMARY OF THE INVENTION

The invention therefore provides an apparatus for curtain coating of paint or varnish on objects having profiled application surfaces, such as profiled door leaves, comprising a curtain head provided with a paint/varnish inlet and return outlet. The curtain head hereby exhibits two curtain lips positioned opposite each other, as well as an upper and a lower flow-equalization rail. The curtain head is further positioned at a predetermined height over a collector channel. A return line connects the return outlet with the collector channel and a conveyor is arranged to feed the profiled object in between the curtain head and the collector channel when applying the paint/varnish. The invention relates specifically to that the curtain height between the lowermost edge of the curtain lips and the application surface of the profiled object is at least 250 mm, and that the distance between the upper and lower flow-equalization rail decreases in a direction from the paint/varnish inlet to the return outlet.

In a preferred embodiment, a throttle valve is provided in said return line, with the help of which a counteracting pressure is created in the curtain head for equalizing the paint/varnish flow.

In a well tested embodiment, said curtain height is preferably within the interval 260–270 mm.

In a very suitable embodiment, from a flow-equalization point of view, the upper flow-equalization rail exhibits at least one hole near the paint/varnish inlet. The hole is preferably circularly shaped and diagonally drilled in such a way that the side wall of the hole is oriented in the direction of flow of the paint/varnish within the curtain head. In a favorable embodiment the upper flow-equalization rail exhibits a plurality of such holes with a decreasing cross section in a direction from the paint/varnish inlet to the return outlet. The holes are hereby preferably five in number.

In an embodiment, which has proven to yield an optimum of flow equalization in the curtain head, both flow-equalization rails are angled relative to each other with an angle between them not exceeding 2°.

In an embodiment advantageous for the evenness of the paint/varnish, the collector channel accommodates a substantially flat collector plate having a width not exceeding 150 mm. Possible air bubbles in the recirculated paint/varnish are hereby eliminated. The collector plate is preferably horizontally oriented in the collector channel The invention also provides a method for curtain coating of paint or varnish on objects having profiled application surfaces, such as profiled door leaves, where the paint/varnish is pumped into a curtain head via a paint/varnish inlet. Within the curtain head the paint/varnish flow is equalized along the length of the curtain head when passing an upper and a lower flow-equalization rail, whereafter a first portion of the paint/varnish via a return outlet and a return line is collected in a collector channel provided beneath the curtain head. A second portion is made to pass two oppositely positioned curtain lips in the lower edge of the curtain head, whereby a paint/varnish curtain is obtained. The object is fed through the paint/varnish curtain by a conveyor and excess paint/varnish is collected in said collector channel. The method relates specifically to that the equalization of the paint/varnish within the curtain head is facilitated partly by applying a counterdirected pressure in the area near the return outlet in the curtain head by reducing the flow in the return line, and partly by facilitating the passage of the paint/varnish through both flow equalization rails in the area near the inlet by providing at least one hole in the upper flow equalization rail. Furthermore, the distance between the upper and the lower flow-equalization rails increases in a direction from the return outlet to the paint/varnish inlet.

In a well tested embodiment the object is preheated to a temperature of 55-60° C.

In an advantageous embodiment, the feed speed of the conveyor does not exceed 60 m/min., the optimum feed speed being 47 m/min.

I an embodiment particularly suited for complete paint covering of said shade sides, the of the paint/varnish is within the interval 25-28 strokes (S).

SHORT DESCRIPTION OF THE DRAWINGS

The invention will in the following be described in detail with reference to the accompanying drawings, in which.

DESCRIPTION OF A PREFERRED EMBODIMENT

Figure 1:
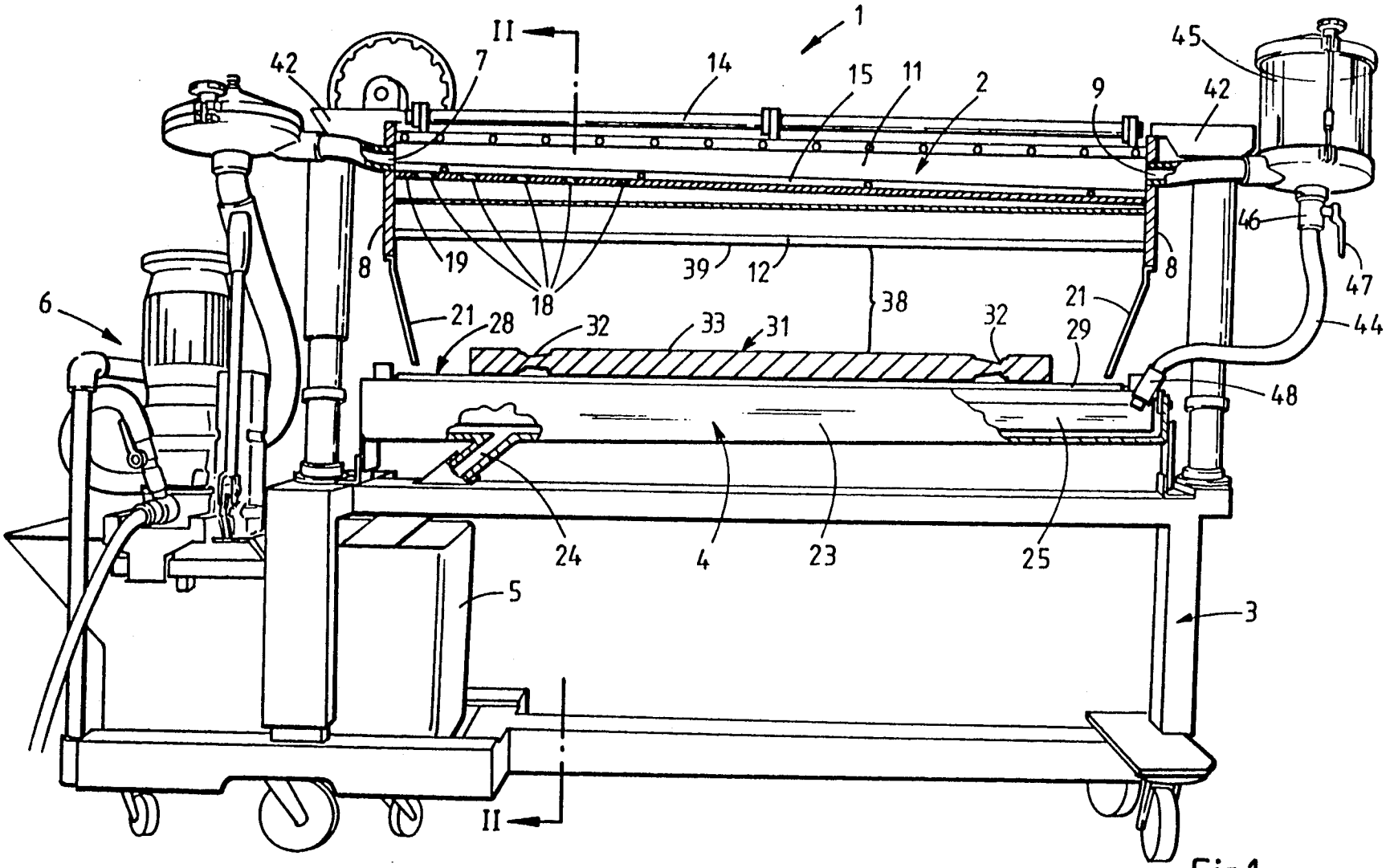
FIG. 1 shows a partly sectionalized front view of a curtain coating apparatus according to the invention.

In FIG. 1, the reference numeral 1 denotes a curtain coating apparatus according to the invention. The apparatus 1 consists mainly of a curtain head 2, a support 3, a collector channel 4, a paint/varnish container 5 and a pump device 6.

The curtain head 2 is provided with a curtain/varnish inlet 7, which can be seen to the left in the figure. The paint/varnish inlet 7 is positioned high up in one of the side pieces 8 of the curtain head 2. In the opposite side piece 8 of the curtain head 2 a return outlet 9 is positioned in a corresponding way.

The curtain head 2 further consists of two openable wall sections 10 and 11, in which lower part are formed longitudinal curtain lips 12. The wall sections 10 and 11 may be opened for cleaning and maintenance by swinging the sections up about the common axis 14.

Figure 2:
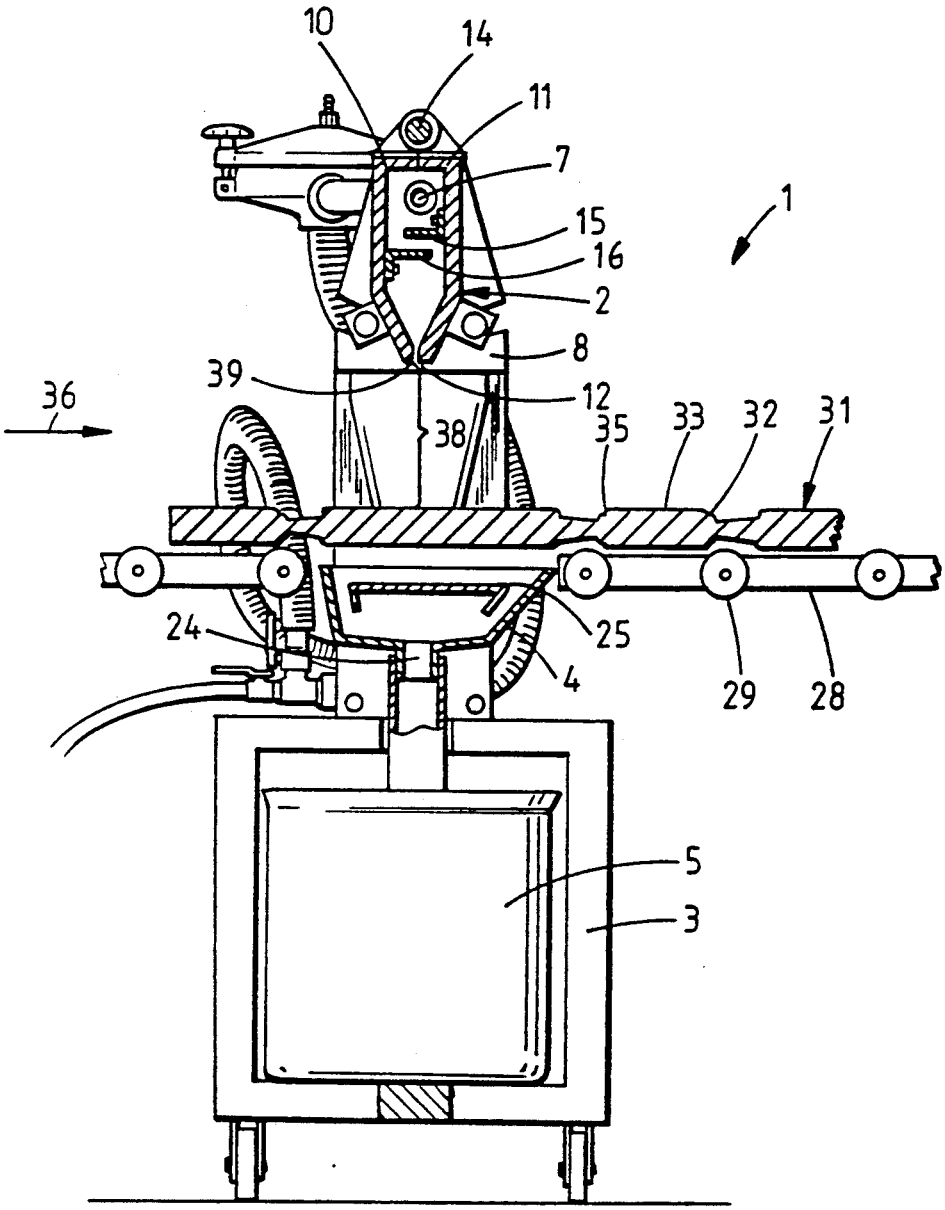
FIG. 2 shows a sectional view on line II—II in FIG. 1.

One of the wall sections 11 is further provided with an upper flow-equalization rail 15, and the other wall section 10 is provided with a lower flow-equalization rail 16. As can be seen in FIG. 1 and 2, the flow-equalization rails 15 and 16 here consists of longitudinal L-profiles extending between the side pieces 8. The distance between the upper 15 and the lower 16 flow-equalization rail decreases in a direction from the paint/varnish inlet 7 to the return outlet 9 since both flowequalization rails 15, 16 are angled relative to each other with an angle inbetween not exceeding 2°. In the area near the paint/varnish inlet 7, five holes 18 are taken up in the upper flow-equalization rail 15. The holes 18 are circularly shaped and diagonally drilled in such a way that the side wall 19 of the holes 18 are oriented in the direction of flow of the paint/varnish within the curtain head 2, i.e. from the paint/varnish inlet 7 and obliquely downwards through the curtain head 2. The holes 18 further exhibit a decreasing cross section in a direction from the paint/varnish inlet 7 to the return outlet 9. The flow-equalization rails 15 and 16 are shaped and angled in the above mentioned way in order to distribute the flow of paint/varnish along the length of the curtain head 2. The reason for this—relative to known curtain heads—extra need for distribution will be explained hereinafter.

In the lower part of the side pieces 8 are attached so called extended curtain lips 21, which function it is to guide the paint/varnish curtain sideways. The extended curtain lips 21 consist of plates extending with a certain angle inwards and downwards toward the collector channel 4.

Figure 4:
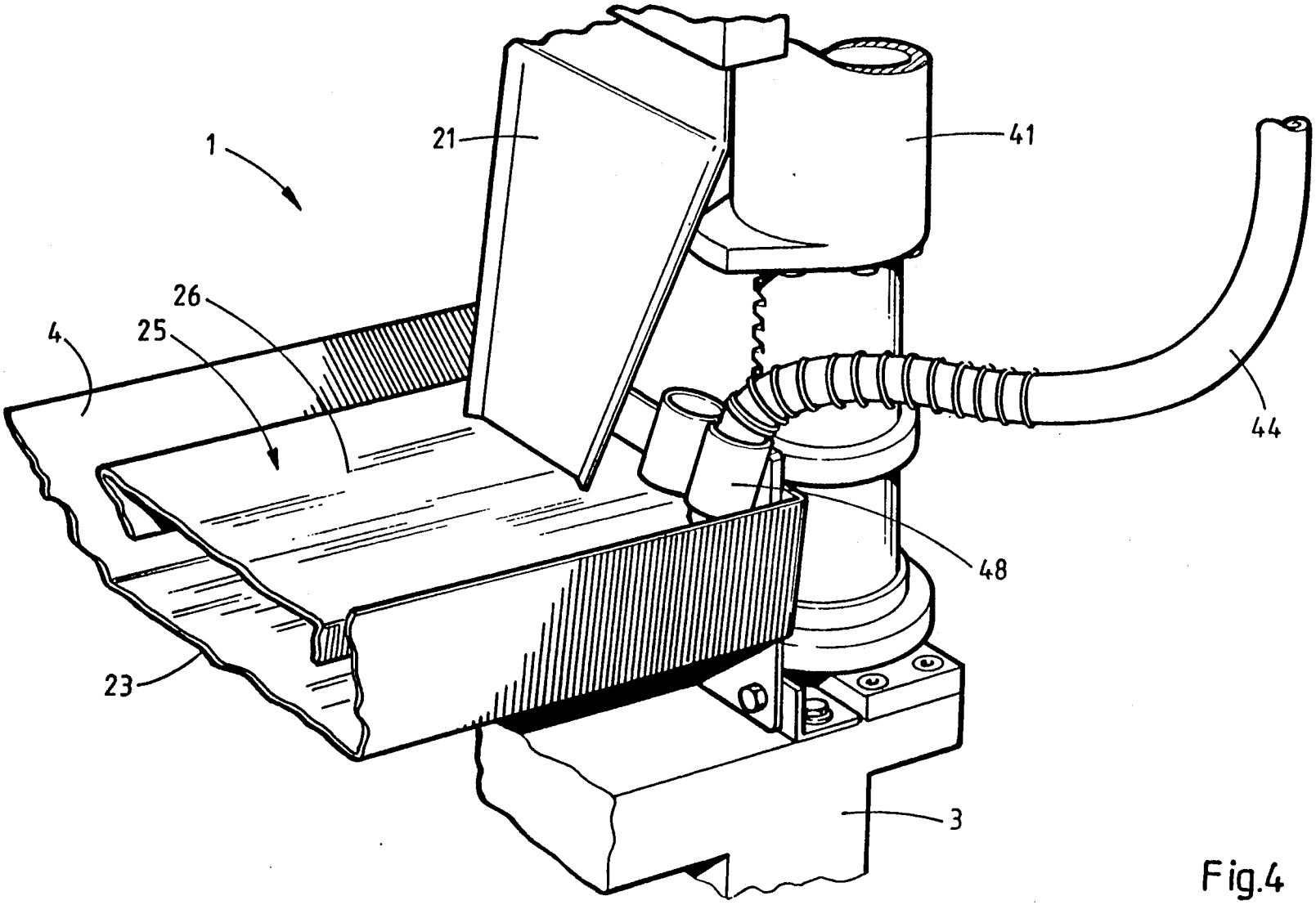
FIG. 4 shows an enlarged, broken perspective view of the collector channel according to the invention.

The collector channel 4 mentioned earlier, is positioned beneath the curtain head 2 for collecting excess paint/varnish. The positioning of the collector channel 4 can clearly be seen in FIGS. 1 and 2. The way, in which the collector channel 4 is built up may however most clearly be seen in the enlarged perspective view of FIG. 4. The bottom side 23 of the collector channel 4 slopes slightly downwards in a direction to the left in FIG. 1, in a known manner, in order to facilitate the return flow of the paint/varnish through an exit line 24 leading the paint/varnish back to the paint/varnish container 5 for further circulation within the system. The collector channel 4 further accommodates a collector plate 25, which upwardly facing surface 26 is substantially flatly shaped. As can be seen in FIG. 2 and 4, the collector plate 25 is horizontally oriented in the collector channel 4. By the certain shape and orientation of the collector plate 25, possible air bubbles in the paint/varnish arising at the instant when the paint/varnish hits the collector plate 25, are eliminated by having the width of the plate 25 (in the direction of feed for the object to be coated) exceed 150 mm, possible air bubbles are given sufficient time to disappear from the paint/varnish before the paint/varnish leaves the collector plate and flows down into the collector channel 4. The paint/varnish which flows down the exit line 24 is thus free from air bubbles.

Figure 3:
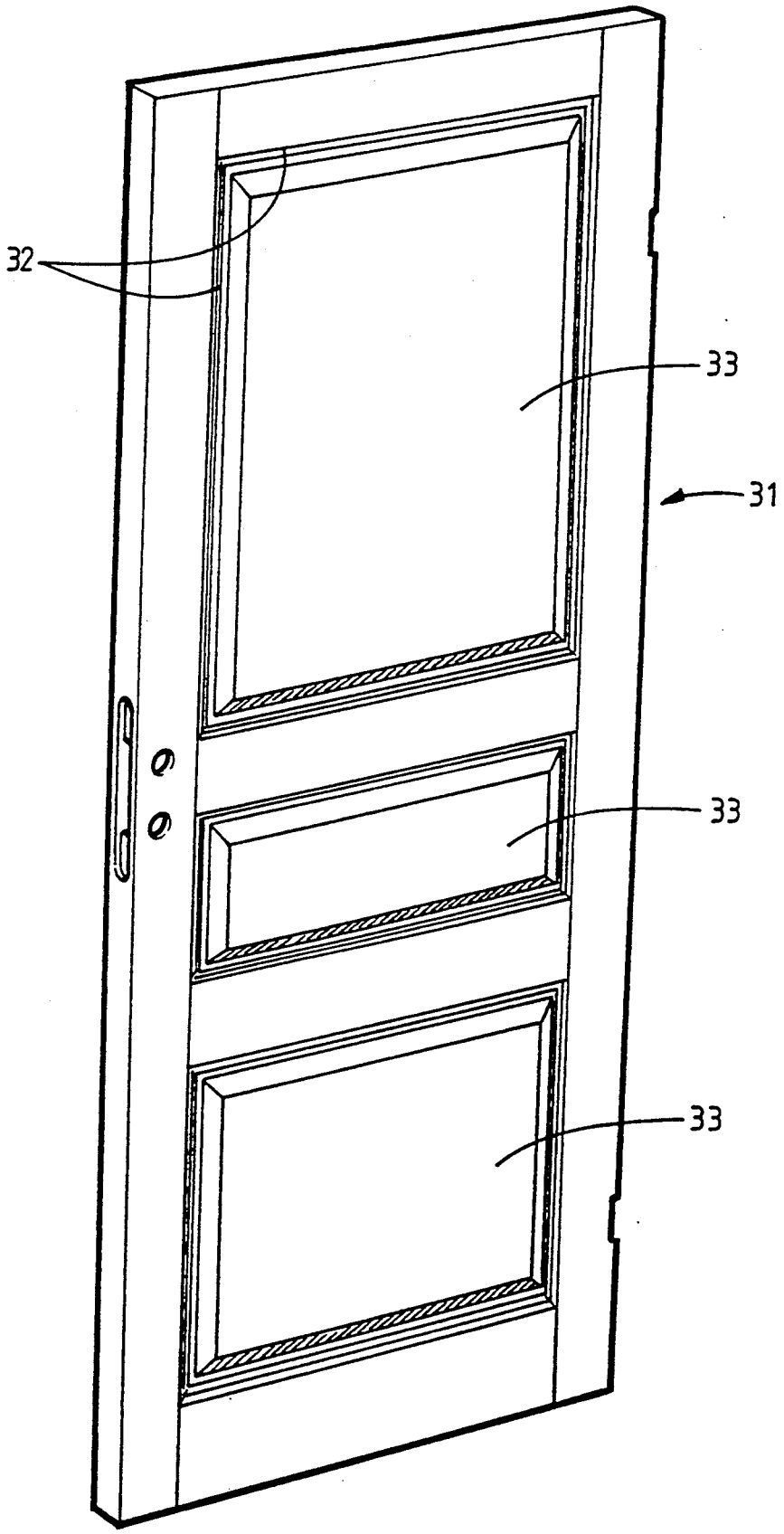
FIG. 3 shows a perspective view of a profiled door leaf as an example of an object having profiled application surfaces.

A conveyor 28 is positioned according to FIG. 2. In the shown example, an object is fed forwards with the help of rollers 29. The object in the example comprises a profiled door leaf 31 of a type having traditional door panels according to FIG. 3, in which a door leaf 31 is shown in perspective without fittings. The door leaf 31 hereby exhibits longitudinal and transversal profiled application surfaces 32 in the shape of recesses defining the panels 33 of the door leaf 31. The initially mentioned so called shade sides 35 of the profiled application surfaces 32 are as mentioned the surfaces facing opposite the direction of feed of the object (the door leaf 31), the direction of feed being defined as the direction of the arrow 36 in FIG. 2.

Figure 5:
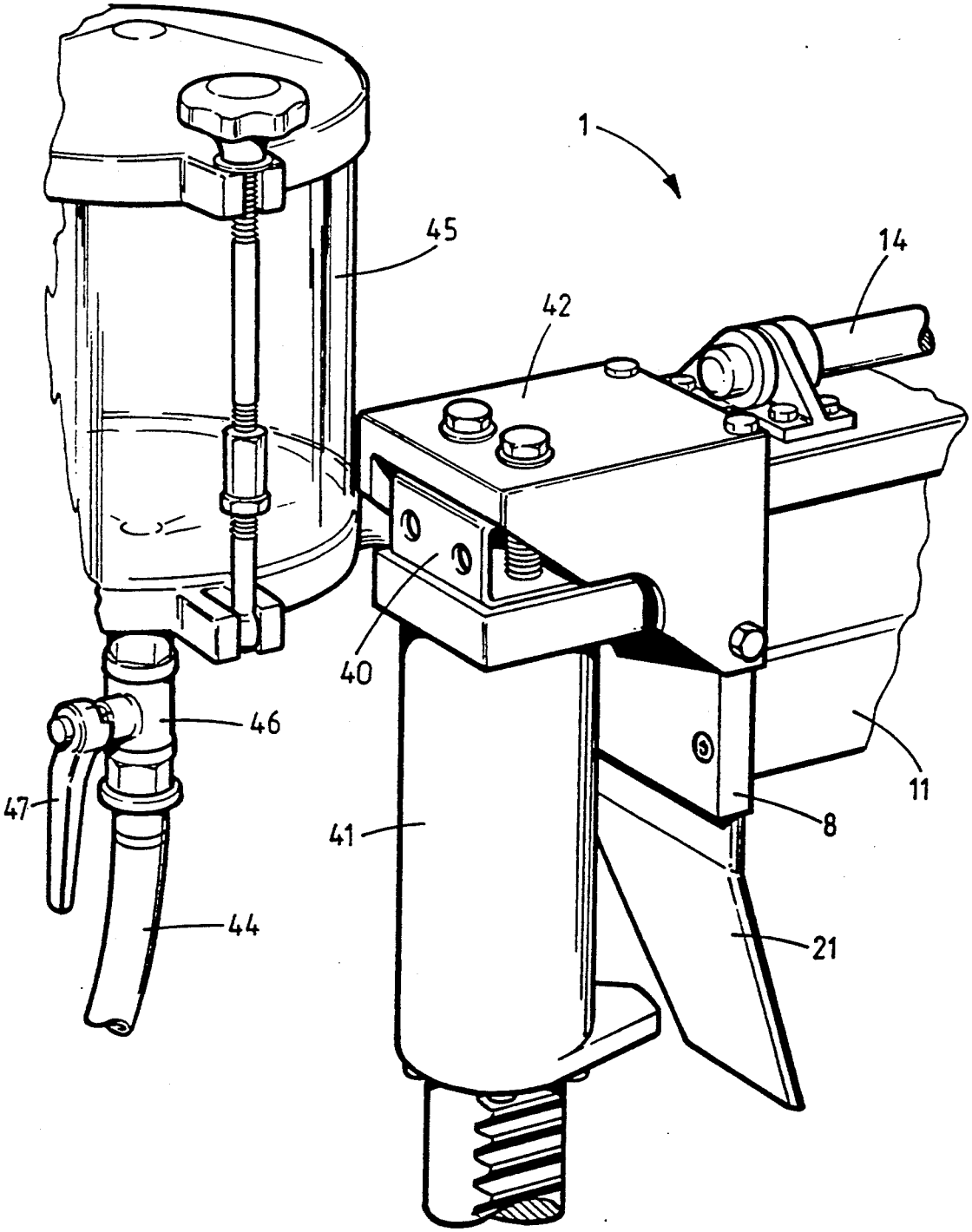
FIG. 5 shows a broken perspective view of the curtain coating apparatus according to the invention, in which an elevation element can be seen.

In order to obtain a satisfactory paint/varnish coverage of said shade sides 35, the curtain height 38 has been raised considerably in relation to normal curtain height according to prior art regarding curtain coating of paint/varnish on objects having flat application surfaces, such as for instance simple flat door leaves. The curtain height 38 is here defined as the height between the lowermost edge 39 of the curtain lips 12 and the application surface 32 of the profiled door leaf 31. The curtain height 38 according to the invention exceeds at least 250 mm, and optimum effect is obtained when the curtain height 38 is within the interval 260-270 mm. In order to achieve this optimum curtain height, the previously known basic structure of the curtain coating apparatus 1 has been fitted with elevation elements 40 positioned between the vertical pillars 41 of the support 3 and two suspension yokes 42 connected with the curtain head 2, as can clearly be seen in FIG. 5.

A return line 44 connects the return outlet 9 with the collector channel, as can clearly be seen in FIGS. 1 and 4. The return outlet 9 is hereby connected to the return line 44 via a level indicator 45. Further, in said return line 44 there is arranged a throttle valve 46, which may be manoeuvred to a suitable throttle level with the help of a manoeuvering handle 47. The function and object of the throttle valve 46 will be described hereinbelow. The return line 44 is connected with the collector channel 44 with the help of a holder 48 attached thereto.

In the following the function of the curtain coating apparatus 1 will be explained with a stress on the basic features special to the invention. Thus the paint/varnish is pumped up from the paint/varnish container 5 with the help of the pump 6, through the paint/varnish inlet 7 into the curtain head 2. Since the curtain height 38 is considerably raised in relation to methods according to prior art, there is a need for a greater paint/varnish flow from the pump 6. As a consequence of the large flow into the curtain head 2 a dominating part of the paint/varnish will gather in the opposite end of the curtain head 2 in the area near the return outlet 9. This tendency is counteracted by facilitating the passage of the paint/varnish through both flow-equalization rails 15 and 16 in the area near the inlet 7, with the help of the aforementioned holes 18 in the upper flow equalization rail 15 and by the fact that the distance between the upper 15 and the lower 16 flow equalization rail increases in a direction from the return outlet 9 to the paint/varnish inlet 7. A further equalization of the paint/varnish flow within the curtain head 2 takes place by applying pressure in the opposite direction in relation to the paint/varnish flow in the area near the return outlet 9 in the curtain head 2 by throttling the flow in the return line 44 with the throttle valve 46. All together, these measures creates an even distribution of the paint/varnish within the curtain head 2, whereby an even paint/varnish curtain is obtained as the paint/varnish passes the two oppositely oriented curtain lips 12. A part of the paint/varnish in the curtain head 2 is hereby led through the return line 44 to the collector channel 4. When applying paint/varnish, the door leaf 31 is fed in between the curtain head 2 and the collector channel 4, through the paint/varnish curtain with the help of the conveyor 28. Excess paint/varnish is hereby collected together with the return flow in the collector channel 4 whereafter it is led back to the paint/varnish container 5 via the exit line 24 for further recirculation.

Another partial factor of the highly satisfactory final results of the application, is high preheating of the door leaf 31. Where a flat door leaf is normally preheated to approximately 45° C. in a prior art curtain coating, the door leaf is preheated to a higher temperature within the interval 45–60° C. in the method according to the invention. Such high preheating has proven to considerably contribute to good coverage of the shade sides 35 since the paint/varnish under such circumstances move with maximum speed. Parallel to the above mentioned increase in preheating of the door leaf 31, the viscosity of the paint/varnish has been lowered according to the invention in order to further facilitate the urge of the paint/varnish to flow out and thus achieve better coverage of said shade sides 35. How much the viscosity is lowered depends on the profile shape, and an extremely suitable viscosity interval has proven to be 25–28 s during extensive tests, which is to be compared with a normal paint/varnish viscosity for known methods of 30–35 s.

In the above described method according to the invention there is, however, an additional factor in this, namely the feed speed of the conveyor 28. This has according to the invention been decreased considerably compared with the feed speed used in prior art curtain coating of flat door leaves. It has here proven suitable for the feed speed not to exceed 60 m/min, and an optimum feed speed has been proven to be 47 m/min during extensive practical tests.

The scope of the invention can now be fully appreciated when every included factor has been explained. Thus, the invention introduces curtain coating with a fully acceptable paint/varnish coverage on objects having profiled application surfaces 32, something which has previously been generally regarded impossible. The sole option for the door industry has therefore previously been the more expensive and considerably more health endangering spray coating method. It is thus the overall effect of all above described factors which yields this unexpected and extremely economically and technically appealing result.

With curtain coating according to the invention a capacity 3–4 times larger than with corresponding spray coating can be achieved—for only a fourth of the spray coating costs.

The present invention is not limited to the above described embodiment and may of course be varied within the scope of the accompanying patent claims.

We claim:

1. Apparatus for the coating of articles having profiled surfaces with a coating liquid comprising longitudinally extending head means for providing a curtain of said coating liquid, said head means including an inlet, a return outlet longitudinally displaced from said inlet, a pair of longitudinally extending lip means defining said curtain of coating liquid, and upper and lower flow equalization rails within said head means for equalizing the flow of said coating liquid through said pair of lip means along the length of said curtain, said upper and lower flow equalization rails being separated from each other by a distance which decreases in said longitudinal direction from said inlet to said return outlet of said head means, collector means positioned below said head means for collecting said coating liquid after said curtain of coating liquid has been applied to said article, return line means for connecting said return outlet to said collector means, and conveyor means for feeding said article between said head means and said collector means for application of said curtain of coating liquid to said article, said conveyor means being positioned below said pair of lip means such that said article is separated from said pair of lip means by a predetermined distance when said article is being fed by said conveyor means.

2. The apparatus of claim 1 wherein said predetermined distance between said pair of lip means and said article being fed by said conveyor means is at last about 250 mm.

3. The apparatus of claim 1 wherein said coating liquid comprises paint or varnish.

4. The apparatus of claim 1 wherein said article comprises profiled door leaves.

5. The apparatus of claim 1 wherein said return line means includes throttle valve means for controlling the flow of said coating liquid through said return line means.

6. The apparatus of claim 2 wherein said predetermined distance is between about 260 and 270 mm.

7. The apparatus of claim 1 wherein said upper flow equalization rail includes at least one aperture therethrough adjacent to said inlet for permitting a portion of said coating liquid to pass through said upper flow equalization rail towards said lower flow equalization rail.

8. The apparatus of claim 7 wherein said upper flow equalization rail includes a plurality of said apertures.

9. The apparatus of claim 7 wherein said aperture is circular and extends diagonally through said upper flow equalization rail facing in the direction of said flow of said coating liquid from said inlet to said return outlet.

10. The apparatus of claim 8 wherein said plurality of apertures extend along said upper flow equalization rail and comprise decreasing cross-sectional areas in the direction of said flow of said coating liquid from said inlet to said return outlet.

11. The apparatus of claim 7 wherein said plurality of apertures comprises five apertures.

12. The apparatus of claim 1 wherein said upper and lower flow equalization rails are disposed at an angle relative to each other of up to about 2°.

13. The apparatus of claim 1 wherein said collector means includes a substantially planar collector plate having a width of up to about 150 mm.

14. The apparatus of claim 1 wherein said collector plate is horizontally oriented in said collector means.

15. A method for the coating of articles having profiled surfaces with a coating liquid comprising providing a supply of said coating liquid, providing a curtain of said coating liquid from a head box positioned above said articles, feeding said coating liquid from said supply of said coating liquid to an inlet into said head box, flowing said coating liquid through said head box from said inlet to a return outlet from said head box and withdrawing at least a portion of said coating liquid from said return outlet from said head box, collecting said coating liquid after said curtain of coating liquid has been applied to said article, returning said at least a portion of said coating liquid withdrawn from said outlet from said head box to said supply of coating liquid, and equalizing said flow of said coating liquid within said head box by controlling said return of said at least a portion of said coating liquid and by providing upper and lower flow equalization rails within said head box separated from each other by a decreasing distance in the direction of said flow of said coating liquid from said inlet to said return outlet in said head box, and feeding said articles below said head box for applying said curtain of coating liquid thereto.

16. The method of claim 15 including separating said head box from said article by a distance of at least about 250 mm.

17. The method of claim 15 wherein said coating liquid comprises paint or varnish.

18. The method of claim 15 wherein said articles comprise profiled door leaves.

19. The method of claim 15 including further equalizing the flow of said coating liquid within said head box by permitting at least a portion of said coating liquid to pass through said upper flow equalization rail onto said lower flow equalization rail.

20. The method of claim 15 including preheating said article to a temperature of between about 55 and 60° C.

21. The method of claim 15 including feeding said article at a rate up to about 60 meters/min.

22. The method of claim 21 wherein said rate is approximately 47 meters/min.

23. The method of claim 15 wherein said coating liquid has a viscosity of between about 25 and 28 S.

* * * * *

UNITED STATES PATENT AND TRADEMARK OFFICE

CERTIFICATE OF CORRECTION

PATENT NO. : 5,096,750

DATED : March 17, 1992

INVENTOR(S) : Per Edlert and Bengt G. Nilsson

It is certified that error appears in the above-identified patent and that said Letters Patent is hereby corrected as shown below:

Column 2, line 49, following "channel" insert --.--.
Column 3, line 14, following "the" insert --viscosity--.
line 61, delete "flowequalization" and insert therefor --flow-equalization--.
Column 7, line 32, following "claim" delete "1" and insert therefor --13--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*